US007284521B2

(12) United States Patent
Lechner et al.

(10) Patent No.: US 7,284,521 B2
(45) Date of Patent: Oct. 23, 2007

(54) SHAFT MECHANISM, IN PARTICULAR CAMSHAFT OF AUTOMOTIVE ENGINES

(75) Inventors: Martin Lechner, Lindlar/Frielingsdorf (DE); Falk Schneider, Münchingen (DE)

(73) Assignee: MAHLE International GmbH, Stuttgart (DE)

( * ) Notice: Subject to any disclaimer, the term of this patent is extended or adjusted under 35 U.S.C. 154(b) by 89 days.

(21) Appl. No.: 11/334,281

(22) Filed: Jan. 18, 2006

(65) Prior Publication Data

US 2006/0157008 A1 Jul. 20, 2006

(30) Foreign Application Priority Data

Jan. 19, 2005 (DE) ..... 10 2005 002 395

(51) Int. Cl.
*F01L 1/04* (2006.01)

(52) U.S. Cl. ..... 123/90.6; 123/90.31; 123/90.15; 123/90.17; 74/567; 74/568 R; 74/569; 29/888.1

(58) Field of Classification Search ..... 123/90.6
See application file for complete search history.

(56) References Cited

U.S. PATENT DOCUMENTS

| | | | |
|---|---|---|---|
| 5,235,939 A | 8/1993 | Levin et al. | |
| 5,664,463 A | 9/1997 | Amborn et al. | |
| 6,725,818 B2 * | 4/2004 | Methley | 123/90.27 |

FOREIGN PATENT DOCUMENTS

| | | |
|---|---|---|
| DE | 39 43 426 | 4/1991 |
| DE | 4416505 | 11/1995 |
| DE | 19757504 | 7/1999 |
| EP | 0643200 | 3/1995 |
| EP | 1362986 | 11/2003 |
| JP | 60009803 | 1/1985 |

OTHER PUBLICATIONS

European Search Report.
European Search Report for EP 1 696 106 (w/translation).

* cited by examiner

*Primary Examiner*—Thomas Denion
*Assistant Examiner*—Kyle M. Riddle
(74) *Attorney, Agent, or Firm*—Collard & Roe, P.C.

(57) ABSTRACT

A camshaft of an automotive engine includes two concentric contra-rotating shafts mounted one inside the other, namely an inside shaft and an outside shaft, at least one cam rotatably mounted on the outside shaft, fixedly connected to the inside shaft radially through the outside shaft via a fastening mechanism, a sleeve gripped by the fastening mechanism and inserted fixedly into aligned boreholes in the inside shaft and in the cam, a core that widens the material of the sleeve within its elasticity limits in the area of the inside shaft and is inserted into the sleeve after insertion of the sleeve into the shaft mechanism. To improve mountability, the core extends over the entire length of the sleeve and widens it beyond the area limited by the inside shaft without exceeding the upper limit of elasticity of the material of the sleeve in comparison with its uninstalled starting state.

9 Claims, 1 Drawing Sheet

SHAFT MECHANISM, IN PARTICULAR CAMSHAFT OF AUTOMOTIVE ENGINES

Figure 1:
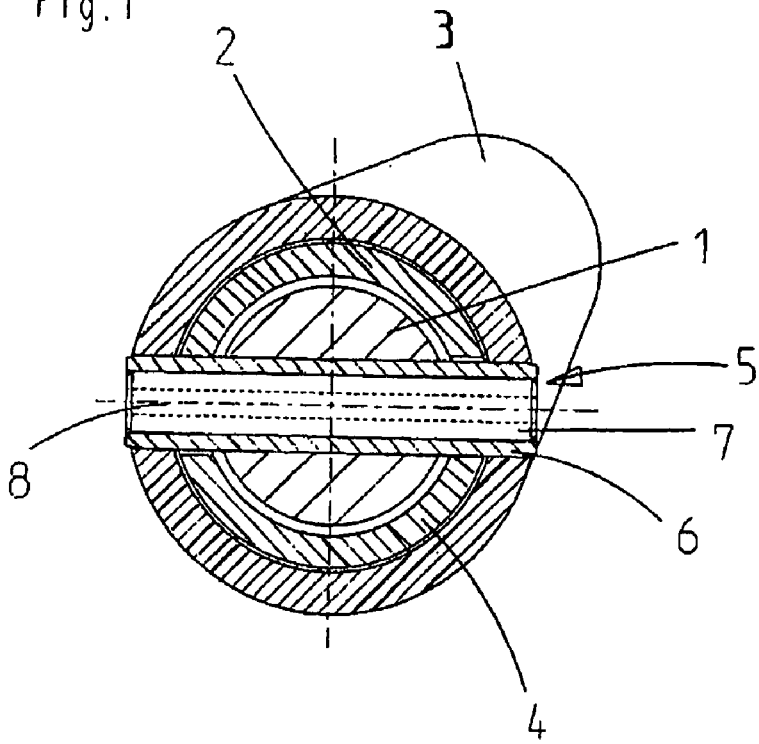

This invention relates to a shaft mechanism, in particular a camshaft of automotive engines according to the preamble of Patent Claim 1.

Such a shaft mechanism is known from European Patent EP 1 362 986 A1. The core, which causes widening of the mounting sleeve there, includes only the area of the mounting sleeve in which it is inside the area of the inside shaft. The end areas of the sleeve, which are situated inside the outside shaft and the cam connected to the inside shaft, are not included. The scope and purpose of the connecting device between the inside shaft and the cam, said connecting device consisting of a sleeve and a core inserted subsequently into this sleeve to widen it, are to have the option of mounting the connecting element in the inside shaft in such a way that no forces can be exerted on the inside shaft due to the mounting operation in such a way as to cause bending of the inside shaft. This is important in particular when the inside shaft is mounted inside the outside shaft in areas that are merely separated far apart axially and when there is a small radial play between the inside shaft and the outside shaft between these bearings and this radial play must not be lost due to bending of the inside shaft while the cam is fixedly connected to the inside shaft. In order for the inside shaft not to be bendable when the cam is connected to it, a sleeve from the fastening mechanism is inserted into a receiving borehole in the inside shaft, said receiving borehole having a diameter of such a size with respect to the outside diameter of the sleeve that the sleeve can be inserted into this borehole within the inside shaft without applying force. When the sleeve for fastening the cam is mounted, the core which widens this sleeve in the area of the inside shaft can be pressed in with axial support of the sleeve without thereby exerting axial forces on the inside shaft.

With the known shaft mechanism, the mounting sleeve is mounted via a fitting of the play in the inside shaft, so after they are assembled, there is already an overlap with respect to the cam material in the area of the cam, namely to such an extent that this already results in a finished, tight connection per se. Subsequent pressing on the core with the known mechanism serves only to widen the sleeve in the area of the inside shaft to achieve a tight seating of this inside shaft with respect to the sleeve, i.e., to achieve a condition without any play, e.g., a press fit with overlap in this area.

If multiple cams are to be connected to the inside shaft on a camshaft of a shaft mechanism distributed over the axial length thereof, then there may be a tolerance problem. This follows from the fact that in the case of a plurality of boreholes which must be aligned accurately with one another between the outside shaft and the inside shaft, this precision cannot always been maintained to the required extent. Due to deviations in dimensions with the mutually aligned boreholes of the inside shaft and cams, sticking may occur when the individual mounting sleeves are introduced inside the respective receiving borehole of the inside shaft, so that when the sleeves are inserted into the inside shaft, radial forces occur with respect to the inside shaft and can shift the latter out of its coaxial position inside the outside shaft. This can result in jamming between the inside shaft and the outside shaft. The present invention is related to eliminating these problems.

The problem on which the present invention is based is solved primarily by an embodiment of a generic shaft mechanism according to the characterizing feature of Patent claim 1.

Advantageous and expedient embodiments are the object of the subclaims.

This invention is based on the following general idea.

The mounting device for connecting a cam to the inside shaft and the receiving bores in the cams and the inside shaft are coordinated with one another so that even if there is a minor misalignment between the boreholes of the cams on the one hand and the inside shaft on the other hand, unforced insertion of the mounting sleeve into the inside shaft can still be ensured with the greatest possible reliability and without applying force even in the case of a relatively long camshaft with multiple cams to be mounted over the length of the shaft.

Due to the measure according to Patent claim 1, the desired security after a force-free introduction of the mounting sleeve into the inside shaft is achieved already due to the fact that the sleeve in the cams has a tight seating that is not yet ready for operation already at the point of introduction into the cam. This already greatly reduces the risk of jamming of the mounting sleeve on introduction into the inside shaft. The tight seating which is not yet adequately achieved in a manner that is reliable in operation at the time of introduction of the mounting sleeve into the cam is achieved according to the present invention through the subsequently inserted core, which extends over the entire length of the mounting sleeve.

Due to the fact that the core extends over the total length of the sleeve, it is extremely easy to secure its position inside the sleeve in the manufacturing process. When the core is flush with the sleeve with respect to its length, it can easily be pressed into the position in which it is aligned with the sleeve.

The sleeve and the receiving bores in the inside shaft and the outside shaft are advantageously coordinated so that there is a greater widening of the sleeve on the finished shaft mechanism in the area of the inside shaft than in the areas radially outside the inside shaft. The differences in the sleeve widening over the length of the sleeve can be supported by the shape of the core by the fact that it has, e.g., conically tapering end areas within the cam to be secured.

An especially advantageous embodiment of the present invention consists of the fact that the sleeve has wall perforations especially in the area in which it forms a press fit inside the inside shaft, so the elasticity of the sleeve can be relatively high in this area if no core has yet been inserted there. The advantage of such an elasticity is that even when there is a minor misalignment of the boreholes in the cam and the inside shaft, high clamping forces which could cause bending of the shaft cannot occur on insertion of the sleeve into the inside shaft. The respective wall passages are designed in particular as slots running so they are axially parallel to the sleeve.

A special form with respect to the inventive wall passages in the sleeve is a sleeve having longitudinal slots over its entire length. Such a sleeve having longitudinal slots has an especially great elasticity in installation and therefore can be installed with practically no application of force, in particular even when there is a minor misalignment of the boreholes involved in the connection.

An especially advantageous exemplary embodiment is illustrated in the drawing and explained in greater detail below.

They show

Figure 2:
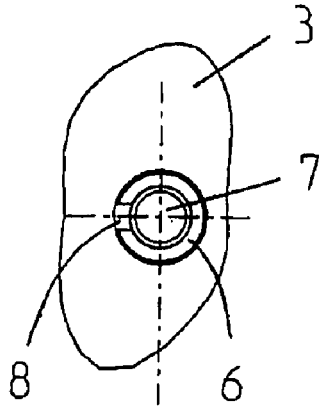

FIG. 1 a cross section through a shaft mechanism having two shafts arranged concentrically one inside the other and a cam (represented here only by a section of a circular ring) mounted on the outside shaft and fixedly connected to the inside shaft, FIG. 2 a detail of a side view of only the area of the mounting sleeve.

In the case of a camshaft as the shaft mechanism consisting of two concentric shafts one inside the other, namely an inside shaft 1 and an outside shaft 2, a cam 3 is rotatably mounted on the outside shaft 2. The cam 3 shown here is the axial ring-shaped connecting area of a double cam (not depicted in the figure to this extent). The cam 3 is connected to the inside shaft 1 via a mounting mechanism 5 by means of a radial recess 4 in the outside shaft 2.

The mounting mechanism 5 consists of a sleeve 6 having longitudinal slots, i.e., a sleeve 6 having a continuous longitudinal slot 8 and a core 7 pressed into the sleeve 6. The core 7 is practically a cylindrical pin. The ends of the core 7 each taper in a slightly conical shape. The conical taper is so minor that it cannot be seen in the drawing. The length of the core 7 is designed so that it extends over the entire length of the sleeve 6.

A uniform elastic deformation of the sleeve material can be achieved over the entire length of the sleeve 6 due to the areas of the core 7 tapering conically at the ends when using a sleeve 6 having a constant inside and outside diameter with different fits with regard to the diameter in the receiving boreholes of the inside shaft 1 on the one hand and the cams 3 on the other hand. The assembly of camshaft with a cam 3 mounted to rotate on the outside shaft 2 is performed as follows:

In a first assembly step, the inside shaft 1 is pushed into the outside shaft 2. Then the mounting sleeve 6 is inserted through the borehole of a cam 3 pushed onto the outside shaft 2 and passed through the inside shaft 1. The sleeve 6 is a cylindrical tube having a uniform inside diameter and outside diameter over the total length. The boreholes in the inside shaft 1 on the one hand and a cam 3 on the other hand into which the mounting sleeve 6 is inserted are coordinated in terms of diameter with the outside diameter of the mounting sleeve 6 so that the sleeve can be inserted while applying the least possible force. Different fits in the area of the inside shaft 1 and the cam 3 are then preferably achieved, with a tighter fit being selected in the area of the cam 3 than in the area of the inside shaft 1. The ends of the pin-shaped core 7 taper conically so that despite the different fits in the area of the inside shaft 1 and/or the cam 3 as described above, a uniform elastic deformation of the sleeve 6 is achieved due to a core 7, which is beneath the overlap in the sleeve 6.

The tight seating between the sleeve 6 and the inside shaft 1 on the one hand and the cam 3 on the other hand is achieved due to an elastic widening of the sleeve material 6 by the core 7 which is situated in this sleeve in the overlap. The core 7 is pressed into the sleeve 6 in such a way that the radial forces occurring there are absorbed directly by the sleeve 6, so that in particular no radial forces can act on the inside shaft 1 with the introduction and activation of the holding properties of this device on the inside shaft 1.

All features described in the description and characterized in the following claims may be essential to the present invention either individually or combined in any form together.

The invention claimed is:

1. A shaft mechanism, in particular a camshaft of automotive engines, comprising two concentric contra-rotating shafts mounted one inside the other, namely an inside shaft (1) and an outside shaft (2), at least one cam (3) rotatably mounted on the outside shaft (2), fixedly connected to the inside shaft (1) radially through the outside shaft (2) via a fastening mechanism (5), a sleeve (6) gripped by the fastening mechanism (5) and inserted fixedly into aligned boreholes in the inside shaft (1) on the one hand and in the cam (2) on the other hand, a core (7) widening the material of the sleeve (6) within its elasticity limits in the area of the inside shaft (1), inserted into the sleeve (6) after insertion of the latter into the shaft mechanism, wherein the core (7) extends over the entire length of the sleeve (6) and widens the latter beyond the range limited by the inside shaft (1) without exceeding the upper limit of elasticity of the material of the sleeve (6) in comparison with its unmounted starting state.

2. The shaft mechanism according to claim 1, wherein the degree of widening of the sleeve (6) in the area of the inside shaft (1) exceeds that outside this area.

3. The shaft mechanism according to claim 2, wherein the different amounts of widening of the sleeve (6) are at least supported by the shape of the core (7).

4. The shaft mechanism according to claim 1, wherein the shape of the core (7) in its end areas outside of the inside shaft (1) is defined by a cone tapering toward the end.

5. The shaft mechanism according to claim 1, wherein the sleeve (6) has wall passages that facilitate the widening at least in its area overlapped by the inside shaft (1).

6. The shaft mechanism according to claim 5, wherein the wall passages are designed as slots (8) running parallel to the axis of the core (7).

7. The shaft mechanism according to claim 5, wherein at least one wall passage extends continuously over the entire length of the sleeve (6).

8. The shaft mechanism according to claim 1, wherein the sleeve (6) lies inside the receiving borehole of the cam (3) with some overlap even without the widening force of the core (7).

9. The shaft mechanism according to claim 7, wherein the mounting sleeve (6) is designed as rolled flat material in the manner of a tension pin according to EN ISO 8752 or EN ISO 13337.

* * * * *